US005490716A

United States Patent [19]

Naughton

[11] Patent Number: 5,490,716

[45] Date of Patent: Feb. 13, 1996

[54] SURGEON'S CHAIR

[76] Inventor: Michael L. Naughton, 2876 S. Wheeling Way, Aurora, Colo. 80014

[21] Appl. No.: 279,406

[22] Filed: Jul. 25, 1994

[51] Int. Cl.[6] ..... A47C 7/50

[52] U.S. Cl. ..... 297/423.12; 297/195.11; 297/488; 297/411.35

[58] Field of Search ..... 297/338, 195.11, 297/487, 488, 423.11, 423.12, 411.2, 344.22, 44.35; 248/282, 118

[56] References Cited

U.S. PATENT DOCUMENTS

| | | | |
|---|---|---|---|
| 2,568,988 | 9/1951 | Childs | 155/157 |
| 3,754,787 | 8/1973 | Garber | 297/390 |
| 4,438,975 | 3/1984 | Williams | 297/411.35 |
| 4,452,487 | 6/1984 | Plowman | 297/411.35 |
| 4,699,423 | 10/1987 | Fitzig et al. | 297/245 |
| 4,832,407 | 5/1989 | Serber | 297/423.12 |
| 4,997,054 | 5/1991 | Denny et al. | 248/118 |
| 5,029,941 | 7/1991 | Twisselmann | 297/411 |
| 5,186,519 | 2/1993 | Larson | 297/338 |

*Primary Examiner*—Peter M. Cuomo
*Assistant Examiner*—Anthony D. Barfield
*Attorney, Agent, or Firm*—Fields, Lewis & Rost

[57] ABSTRACT

An improved surgeon's chair is disclosed providing adjustable bodily support to a seated surgeon to prevent inadvertent fatigue, and a design enabling access to the chair without compromising the sterility of the surrounding operating area. The chair includes a frame assembly that supports both a seat assembly and a dual pivoting support having a plurality of body pads. A lifting mechanism attached to the seat assembly allows the seat assembly to be positioned at the desired vertical height. A knee rest assembly connected to the frame assembly provides support to the knees and shins of the surgeon. The dual pivoting support includes upper and lower sections that are independently rotatable and which rotate around respective laterally spaced vertical axes. The lower rotational section allows the body pads to be selectively positioned according to the girth and comfort of the surgeon. A releasable locking device on the upper rotational section is provided to allow selective positioning of the upper rotational section according to the comfort of the surgeon and to maintain operating area sterility when the surgeon approaches and leaves the chair.

20 Claims, 4 Drawing Sheets

Fig_1
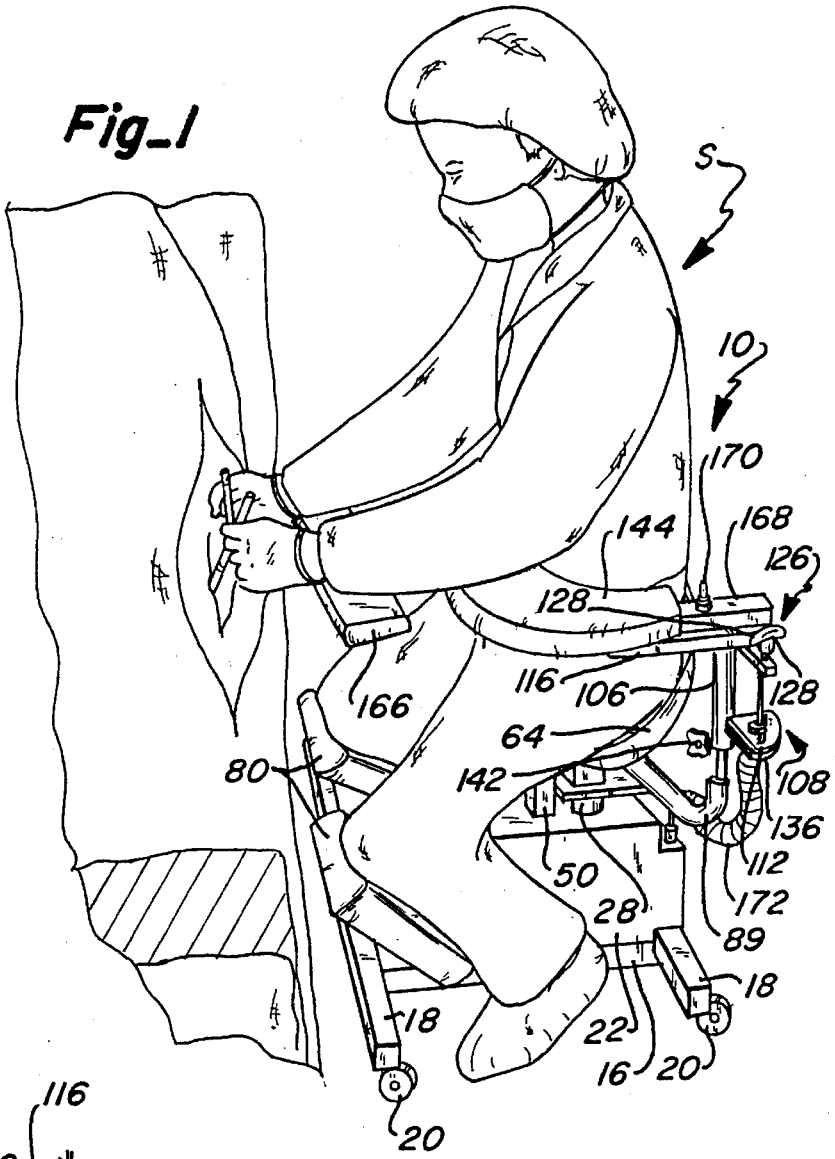
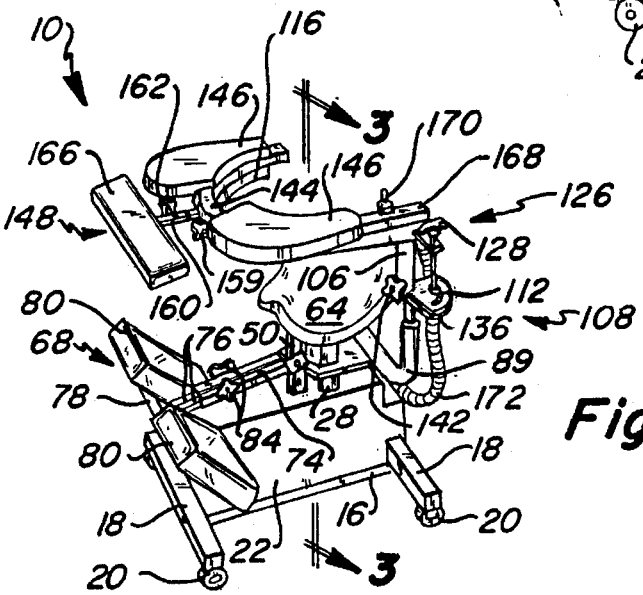
Fig_2

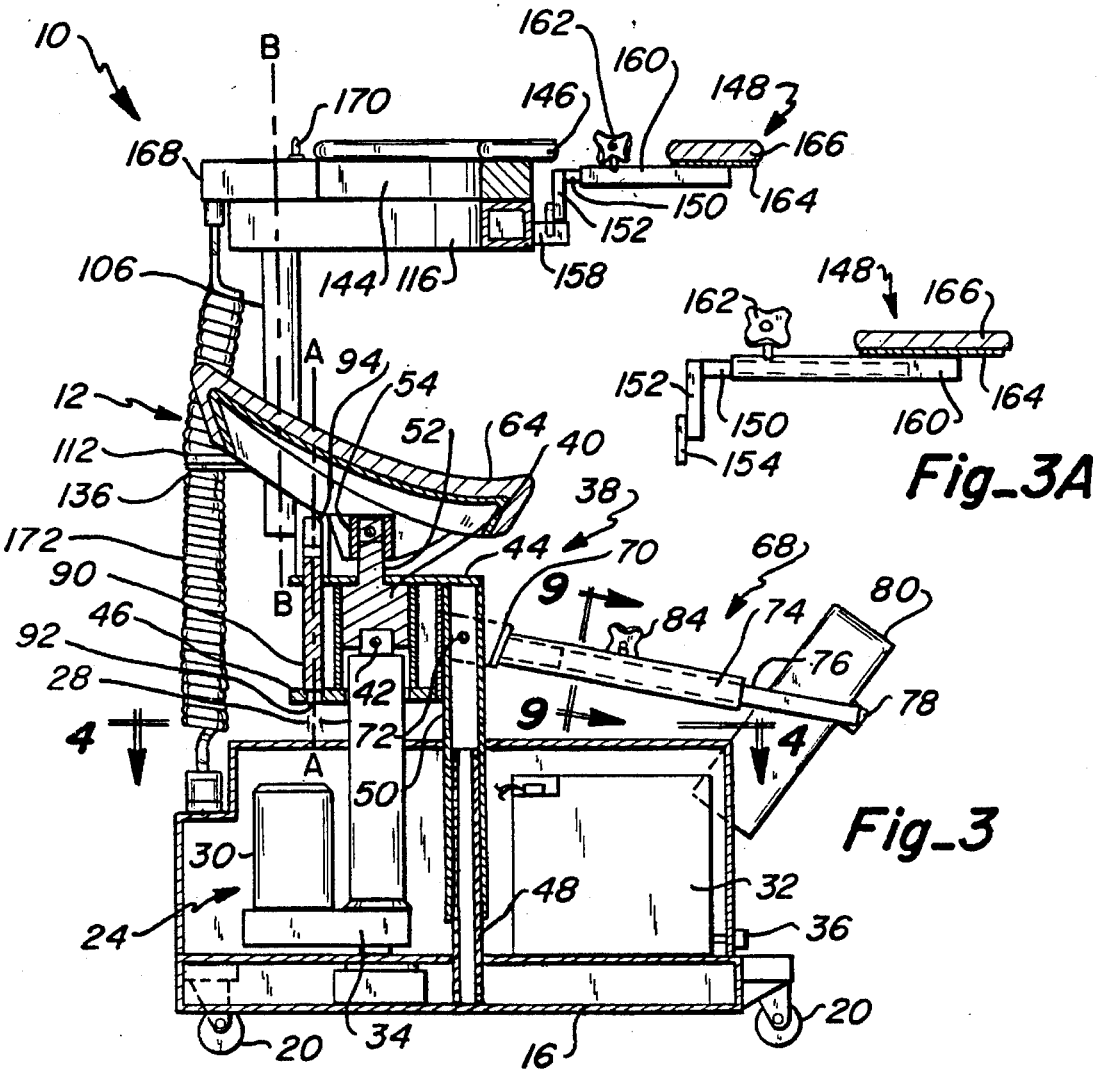
Fig_3A
Fig_3
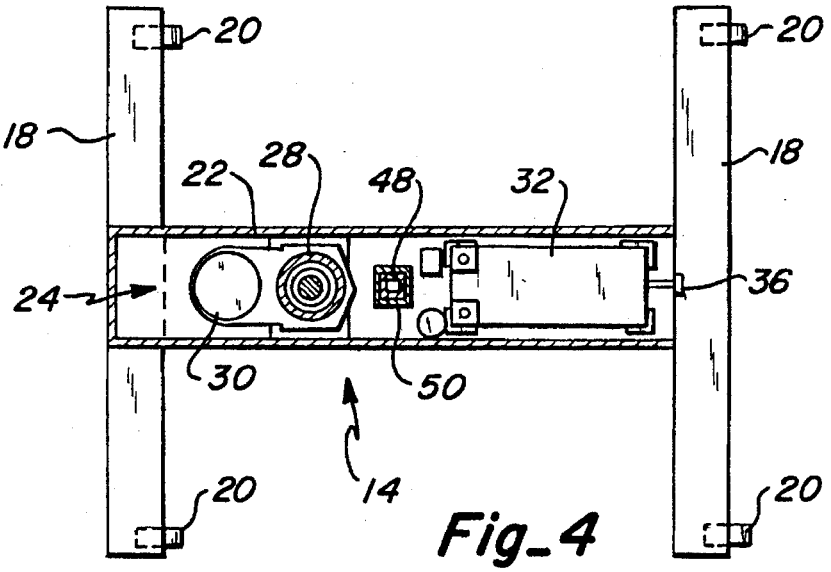
Fig_4

SURGEON' S CHAIR

TECHNICAL FIELD

This invention relates to a device for providing bodily support to a surgeon during a surgical process. Specifically, this invention is a surgical chair providing increased comfort and bodily support to the surgeon. Furthermore, the chair design enables the surgeon to access the chair without compromising the sterility of the surrounding surgical area.

BACKGROUND ART

Numerous inventions exist which disclose chairs or other support devices that provide stability to the surgeon's body during surgery. Because many surgical procedures can be quite lengthy, it is imperative that the surgeon be kept in a comfortable position so that the surgeon may concentrate on the work at hand with a minimum amount of discomfort. Medical researchers have demonstrated the superiority of a sitting posture which decreases the angle of the thighs in relation to the torso from the traditional 90°. Normally, a sit-kneel type chair is provided with a seat which is angled 15° to 30° forward with a correspondingly angled knee rest. This style of chair and sitting posture have the advantages of distributing some of a person's weight to the knees and shins thus taking pressure off the posterior. In addition, a sit-kneel type chair restores the natural curve of the lumbar spine thus relieving pressure from the back, while at the same time uncramping the torso for freer breathing and circulation. Important additional advantages of this type of chair are that it provides for a more upright posture for the surgeon leaning over the patient's body resulting in improved access to and viewing of the surgical cavity, and a downward angle for the thigh facilitating a closer interface of the surgeon to the operating table.

Medical researchers have also shown the desirability of a tilting seat over a traditional fixed flat seat. Over time, sitting in a fixed posture produces increased restlessness. A tilting seat allows natural movement facilitating a much less restrained posture. Additional advantages include the fact that when the seat height is raised higher than the back of the knee, the seat tilts forward thus preventing undue pressure on the back of the thigh, constriction of the femoral arteries, and pressure on the sciatic nerve.

One of the disadvantages of the prior art has been that the chair or support device did not adequately support a critical portion of the surgeon's body which resulted in inadvertent surgeon fatigue. Another disadvantage of the prior art is that for those inventions which have provided support in the needed bodily areas, these inventions have been complex and expensive to manufacture. Yet another disadvantage of the prior art is that the surgeon often had to expose a non-sterile portion of the body to a sterile portion of the chair in order to access the chair. This exposure created sterility problems in the surrounding surgical area.

One example of a surgeon's chair is found in U.S. Pat. No. 5,029,941 to Twisselmann which discloses a device comprising an adjustable chair portion and an adjustable arm rest portion which may be locked into the desired position by the surgeon.

Other examples include U.S. Pat. No. 3,754,787 to Gerber and U.S. Pat. No. 4,699,423 to Fitzig et al. which disclose surgical-type chairs providing support to the torso and elbows of a surgeon.

U.S. Pat. No. 2,568,988 to Childs discloses a dentist chair which provides a swivel portion which may be alternatively used either as a back support or front torso support. A disadvantage of this device and many other similar devices is that the swivel portion cannot be used as a front torso support in surgery. If the swivel portion is in contact with the front of a surgeon's sterile gown, it must be sterilized or covered with a sterile drape. The back side of a surgeon is not considered sterile, therefore, as the surgeon sits in the chair and the surgeon's back contacts the swivel portion, the swivel portion is no longer considered sterile and cannot be swiveled in front of the surgeon.

A front torso support is particularly advantageous for a chair with a tilting seat as the torso support serves to stabilize the trunk of the body while the lower extremities are allowed to flex with the tilting seat. The front support also prevents sliding off the seat when the chair is tilted forward or when trying to move the chair. This front support is especially important when a knee rest is not used.

It is a primary object of this invention to provide for a surgical chair that enables access by a surgeon without compromising the sterility of the surrounding surgical area.

It is one object of this invention to provide for a chair which provides support to the torso and arms of a surgeon during delicate procedures such as microsurgery when the torso and arms require stabilization.

It is another object of this invention to provide for a device which reduces the stress on the spine by providing a knee rest support.

Another object of this invention is to provide for a surgical chair with torso and arm supports that may be selectively adjusted to the desired horizontal and vertical position along with a lifting mechanism that allows the surgeon to selectively adjust the vertical height of the seat.

Yet another object of this invention is to provide for remotely located controls for adjustment of the vertical height of the seat and horizontal adjustment of the torso, arm and wrist supports by a scrubbed surgeon. The controls are located above the surgeon's waist, below which is not considered sterile, and are easily operated beneath a sterile drape.

While the prior art references may be adequate for their intended purposes, none of the references disclose the novel elements set forth herein.

DISCLOSURE OF THE INVENTION

In accordance with this invention, an improved surgeon's chair is provided. The chair comprises a frame assembly which supports both a seat assembly and a dual pivoting support having a plurality of body support pads to support the torso and arms of the seated surgeon. A knee rest assembly is attached to the frame assembly to further provide for comfort of the surgeon.

The dual pivoting support includes upper and lower rotational sections that are independently rotatable about respective laterally spaced, vertical axes.

The lower rotational section is attached to the frame assembly in which the axis of rotation is located near the seat assembly. This lower section may be freely rotated in approximately a 180° arc. The upper rotational section is attached to the free rotating end of the lower rotational section and may be freely rotated in approximately a 45° arc. The axis of rotation for the upper rotational section passes vertically through the point of attachment between the lower and upper rotational sections.

The upper rotational section may be selectively locked into the desired radial position by means of a releasable locking device attached to the upper section. The device includes a swivel adjustment bracket with an insertable spring plunger assembly that is alignable with holes formed in an arcuate slot of the bracket. The upper rotational section can be selectively adjusted and locked into position by placing an extendable pin of the spring plunger assembly into the corresponding hole of the swivel adjustment bracket.

The upper rotational section may be adjusted to the desired vertical height by means of a vertical locking mechanism.

Mounted on the frame assembly are a plurality of swivel casters which enables the surgeon's chair to be rolled to the desired location. Further mounted on the frame assembly is a seat lifting mechanism which can adjustably raise the seat assembly to the desired vertical height. The lifting mechanism may include a linear actuator or fluidic cylinder which is powered by a motor or pump. A source of power, such as a battery, is also mounted on the support assembly to provide power to the lifting mechanism. The battery may be recharged by means of an external power source which may be electrically coupled to the battery by a plug receptacle located on the frame assembly.

The seat assembly is pivotable in a forward or rear tilting position which enables the surgeon to be more comfortably positioned.

The knee rest assembly includes adjustable telescoping tubes which enable the knee rest to be positioned at the desired distance from the seat assembly.

Mounted on the upper rotational section are a plurality of pads for support of the surgeon's torso and arms. Specifically, torso pads and elbow pads are provided. Furthermore, a removable and adjustable wrist rest assembly may be mounted on the upper rotational section to support the wrists of a surgeon.

The range of movement created by the independent rotation of the upper and lower rotational sections allows the surgeon to selectively place the body support pads in any position relative to the seat assembly. When entering the chair before the surgical process begins, the upper rotational section is rotated approximately 45° away from the seat assembly and the lower rotational section is also rotated slightly away facilitating entry of the surgeon. Obtaining access to the chair in this manner results in the sterile upper rotational section remaining forward of the seat assembly. Therefore, sterility is maintained because only the front sterile side of the surgeon comes in contact with the upper rotational section. When seated, the surgeon swings back the lower rotational section and then selectively positions the upper rotational section in the desired location. If the surgeon desires to get up from the chair during surgery, sterility of the surrounding surgical area can be maintained by first rotating away the upper rotational section to a forward position then rotating the lower rotational section away to a position where the surgeon can stand up.

From the foregoing, it will be apparent that this device provides many advantages. The knee rest assembly reduces stress on the spine of the surgeon. The body support pads of the upper rotational section allows the surgeon to sit in a supported position such that the torso and arms are stabilized. The adjustable wrist rest assembly further allows the surgeon to stabilize the arms for delicate surgical procedures such as micro-surgery. The novel combination of a dual pivoting support enables the surgeon to access the chair without compromising sterility and to adjust numerous supporting pads to the exact desired position. The non-locking feature of the lower rotational section allows the surgeon to continually make small incremental adjustments to the radial position of the body support pads without having to utilize some type locking mechanism. Lastly, the seat lifting mechanism and the pivotal seat assembly allow the surgeon to be seated at the desired vertical level and angle in relation to the surgical area.

Additional advantages of this invention will become apparent from the description which follows, taken in conjunction with the accompanying drawings.

BRIEF DESCRIPTION OF THE DRAWINGS

FIG. 1 is a perspective view of an improved surgeon's chair constructed in accordance with this invention showing a seated surgeon;

FIG. 2 is another perspective view as in FIG. 1 without the seated surgeon;

FIG. 3 is an enlarged vertical section taken along line 3—3 of FIG. 2, showing the internal construction of part of the surgeon's chair;

FIG. 3A is a greatly enlarged side view of the wrist rest assembly separated from the surgeon's chair;

FIG. 4 is a horizontal section taken along line 4—4 of FIG. 3, showing the internal construction of part of the surgeon's chair;

BEST MODE FOR CARRYING OUT THE INVENTION

Figure 5:
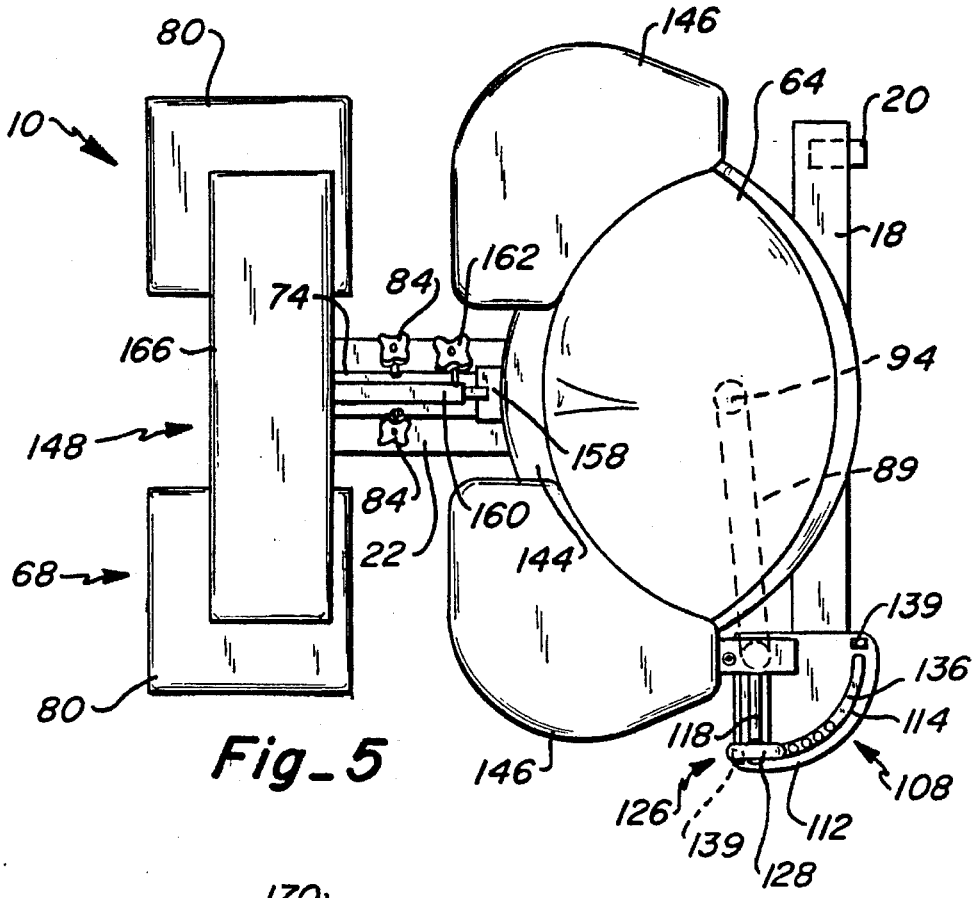
FIG. 5 is an enlarged top plan view of the surgeon's chair.

In accordance with the present invention, an improved surgical chair 10 is provided which includes an upper frame section 12 and a lower frame section 14.

The lower frame section 14, as best seen in FIG. 4, includes a main support bar 16 which has a plurality of cross-member supports 18 attached thereto in a perpendicular arrangement. Attached to each cross-member support 18 are a plurality of swivel casters 20 which enable the device to be rolled along a floor. Mounted on the lower frame section 14 is a lifting mechanism 24 for raising or lowering a seat assembly 26. The lifting mechanism 24 includes a linear actuator 28 which is driven by a motor 30. The linear actuator may be extended or retracted in a vertical direction thus giving the seat assembly 26 the desired vertical position. Motor 30 is energized by a source of power, such as a common battery 32. Power wires (not shown) connect the battery 32 to the motor 30. A series of gears (not shown)

within gear housing base 34 are used to translate motion from the motor 30 to the linear actuator 28. It will be understood that actuator 28 and motor 30 can be replaced with a fluidic lift mechanism, such as a hydraulic cylinder and pump. A housing 22 is mounted over the lifting mechanism 24, motor 30, and battery 32. A plug receptacle 36 is electrically connected to battery 32 in order that it may be recharged by an external power source (not shown). Conveniently, the plug receptacle 36 may be attached to the front end of main support bar 16 with electrical wiring (not shown) extending through the interior portion of bar 16 to the battery 32. Thus, while battery 32 is charged, the device may be freely moved to any location without the encumbrance of a power cord.

It will also be understood that the lifting mechanism 24, battery 32, housing 22, plug receptacle 36 and associated wiring could be eliminated and replaced with a conventional non-powered gas lift.

The upper frame section 12 includes a support bracket 38 having a central web element 40 delimited by an integral upper flange 44 and lower flange 46. At a forward end of the upper frame section 12 is attached an upper alignment tube 50. A lower alignment tube 48 is attached to the main support bar 16. The upper alignment tube 50 telescopes over the lower alignment tube 48 to provide additional cantilever support to the seat assembly 26.

The linear actuator 28 is attached to the central web element 40 by means of a transverse support bracket bolt 42° Thus, the vertical movement of the linear actuator 28 causes corresponding vertical movement of the attached support bracket 38 and upper alignment tube 50.

The seat assembly 26 comprises a first support means 52 which is attached perpendicularly to the upper flange 44. A pivotable mounting block means 54 is secured to the first support means 52. Mounted to the means 54 is a saddle seat 64. Saddle seat 64 may be rocked to a forward or rearward position depending upon the force applied by a seated surgeon. Although the preferred embodiment illustrates a pivotal seat, it will be understood that the seat 64 may also be fixed to prevent this rocking motion or alternately be allowed to selectively rock by use of a removable pin.

Figure 9:
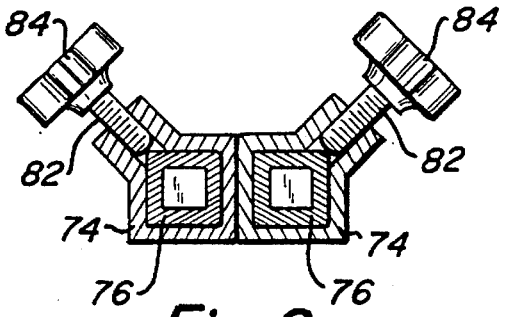
FIG. 9 is a cross-section taken along line 9—9 of FIG. 3, showing the internal construction of a portion of the knee rest assembly.
Figure 10:
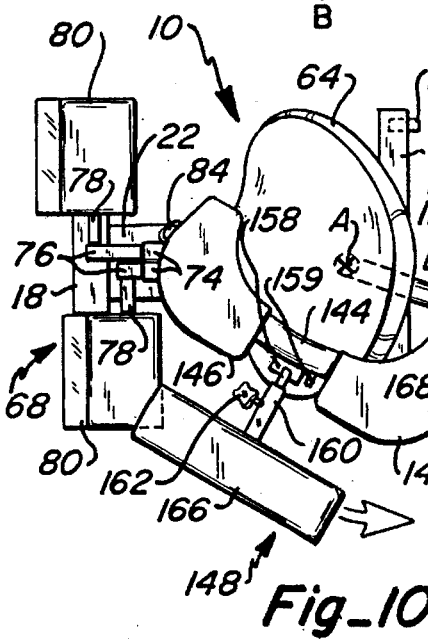
FIGS. 10 and 11 are each a top plan view of the surgeon's chair respectively showing the upper and lower rotational sections in differing angular positions with respect to axes A—A and B—B.

Attached to the upper alignment tube 50 is a knee rest assembly 68. The assembly 68 includes a knee rest mounting bracket 70 secured to the tube 50 by mounting bracket bolt 72. As best seen in FIG. 2 and 10, a pair of knee rest mounting tubes 74 are attached to mounting bracket 70. Positioned inside the mounting tubes 74 are respective telescoping tubes 76. At a distal end of each telescoping tube 76 is attached a knee rest cross-member 78 with attached padded knee pad 80. As best seen in FIG. 9, an engagement stud 82 with adjustable fluted handle 84 is provided to adjust the length of extension of each telescoping tube 76 such that the distance between the seat assembly 12 and the knee rest assembly 68 is tailored to the size of the particular surgeon. Although the figures show the use of two telescoping tubes 76 with corresponding knee pads 80, it will be understood that a single telescoping tube may be used in conjunction with a pair of attached knee pads.

Figure 6:
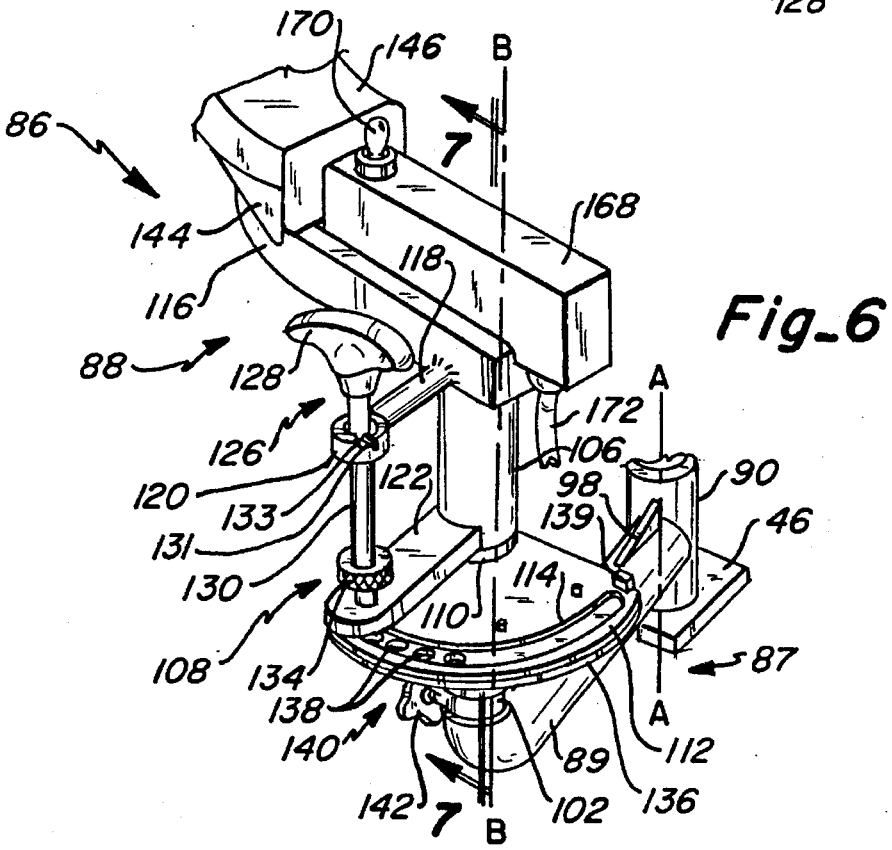
FIG. 6 is a greatly enlarged perspective view of the releasable locking device of the upper rotational section.
Figure 7:
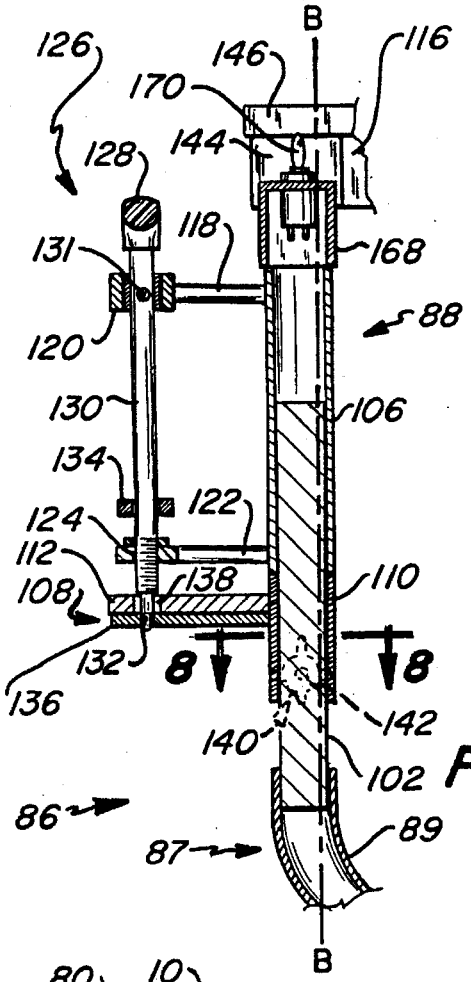
FIG. 7 is a fragmentary vertical section taken along line 7—7 of FIG. 6, showing the internal construction of the releasable locking device.

As best seen in FIG. 6, dual pivoting support 86 includes lower rotational section 87 and upper rotational section 88. The lower rotational section 87 includes a horizontal tube with upturned end 89 and integral short vertical tube 90 that extends upwardly through an opening formed in the upper flange 44. Lower rotational section 87 is attached to the support section 12 by means of a retaining pin (not shown) which extends through tube 90 and is seated in a countersunk hole 92 of the lower flange 46. As shown in FIG. 3, the retaining pin is equipped with a cap 94 positioned on the upper end of the retaining pin to facilitate its removal. Referring to FIGS. 3 and 6, the lower rotational section is rotatable about vertical axis A—A. A support web 98 is attached to the tube 89 at the upper flange 44 in order to give the tube 89 additional bending moment support. As best seen in FIG. 7, inserted in the upturned vertical end of tube 89 is a round post 102 having a key way formed on its external surface. Mounted over the round post 102 is a releasable locking device 108 having a support member 110 that telescopes over the round post 102. The upper end of round post 102 extends upwardly through the support member 110 and receives in telescoped relationship an upper rotational section 88. Referring to FIGS. 6 and 7, the upper rotational section 88 is rotatable about vertical axis B—B. Upper section 88 includes a vertical support extension 106 and a horizontal semi-circular extension 116 attached thereto.

The releasable locking device 108 is provided to allow the surgeon to selectively position and lock in place the upper rotational section 88 in the desired radial position. The device 108 includes a swivel adjustment bracket 112 with arcuate shaped slot 114 perpendicularly attached to the support member 110 such that bracket 112 extends horizontally away from the round post 102. An upper horizontal supporting arm 118 with slotted ring 120 and a lower horizontal supporting arm 122 with threaded hole 124 are connected to extension 106. On the bottom surface of swivel bracket 112 is attached a flat plate 136 having a plurality of arcuately spaced holes 138 that are exposed by the arcuate slot 114 of swivel bracket 112. The support arms 118 and 122 are vertically aligned for receiving a spring plunger assembly 126 through the slotted ring 120 and threaded hole 124.

Figure 11:
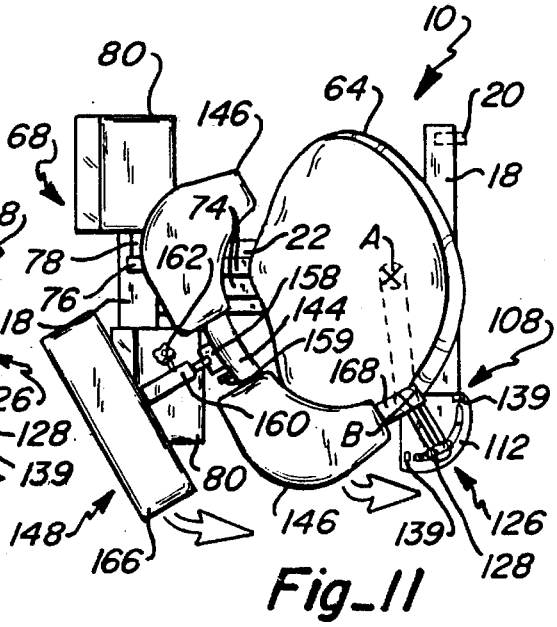

The spring plunger assembly 126 includes a pull knob 128 attached to a plunger tube 130. Inside the tube 130 is a spring mechanism (not shown) which is positioned between the arm 122 and retaining stud 134. A retaining pin 131 is connected to the top end of tube 130. As shown in FIG. 6, retaining pin 131 is seated in slot 133. When the knob 128 is pulled upwardly, the pin 131 can rest on the top edge of bracket 118 thereby keeping the spring plunger retracted to allow unimpeded swivel of the upper rotational section 88. When it is desired to change the radial position of the upper rotational section 88, the surgeon lifts up on the pull knob 128, swivels the upper rotational section 88 to the desired position, places the plunger pin 132 in the corresponding exposed hole 138 and seats retaining pin 131 in slot 133. The insertion of plunger pin 132 into corresponding hole 138 and seating pin 131 in slot 133 locks the upper rotational section 88 in place. Referring to FIGS. 6, 10 and 11, the rotational movement of the upper rotational section 88 is limited to approximately a 45° arc by means of two stops 139 positioned on the outer edges of swivel adjustment bracket 112. This limited movement ensures that the upper rotational section 88 is not inadvertently rotated behind the seated surgeon to an unsterile area.

Figure 8:
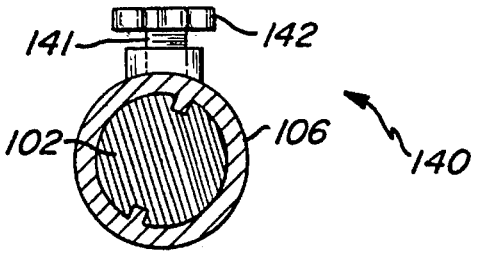
FIG. 8 is a horizontal section taken along line 8—8 of FIG. 7, showing the internal construction of the vertical locking mechanism.

A vertical locking mechanism 140, as best seen in FIG. 8, is provided to allow selective adjustment of the upper rotational section 88 to the desired vertical position. The mechanism 140 includes a stud 141 and fluted handle 142. The upper rotational section 88 is slidable over the round post 102 when the mechanism 140 is loosened. Tightening the adjustable fluted handle 142 causes the stud 141 to frictionally engage the round post 102.

Attached to the interior side edge of semi-circular extension 116 is body rest pad 144. Typically, the pad 144 extends along the entire radius of extension 116. On the top edge of the semi-circular extension 116 are attached two elbow rest pads 146 to accommodate support for each elbow.

As shown in FIG. 3, at the center portion of extension 116 is attached a wrist rest assembly 148. As shown in FIG. 3A, the assembly 148 includes a slotted front support bar 150 that has attached at its proximal end a first vertical attachment bar 152 and a second vertical attachment bar 154. A wrist rest mounting block 158 with fluted handle 159 are attached to the extension 116. Second vertical attachment bar 154 is placed through a slot formed in mounting block 158 wherein a mounting block stud (not shown) and the fluted handle 159 frictionally secures the bar 154 to the mounting block 158. The wrist rest assembly 148 further includes a telescoping front slotted tube 160 that is telescoped over front support bar 150. A stop screw (not shown) positioned within bar 150 is provided to prevent inadvertent extension of the slotted tube 160 to a position where it may extend beyond the distal end of support bar 150. A stud (not shown) with adjustable fluted handle 162 are used to frictionally secure the telescoping slotted tube 160 to the support bar 150. At the distal end of telescoping slotted tube 160 is attached a front support cross-member 164 having a wrist rest pad 166. Pad 166 may be adjusted to the desired distance from extension 116 by positioning slotted tube 160 and then locking the slotted tube 160 in place by handle 162.

As shown in FIG. 6, mounted on the top edge of extension 116 is a switch housing 168 and toggle switch 170 for remote control of lifting mechanism 24. Coiled wire 172 extends from housing 168 to motor 30.

In another embodiment, the extension 116 may be alternatively configured in a half semi-circular shape in which the elbow rest pads 146 and wrist rest assembly 148 are removed. Depending upon the type of surgery required and the needed bodily support, this second embodiment may be advantageous for procedures in which support of the arms and wrists is unnecessary and in which only limited torso support is required.

Although the releasable locking device 108 has been described in particular detail, it will be understood by those skilled in the art that any suitable locking device may be used. Any combination of a locking element and a receiving element can be used whereby the upper rotational section can be selectively positioned. For example, the locking element could comprise of a common clamp or other similar frictional engagement devices. The receiving element could comprise of a series of ribbed surfaces corresponding to the locking element or other suitable receiving configurations for which the locking element could be attached for selective positioning.

Furthermore, it will be understood that the toggle switch 170, switch housing 168 and coiled wire 172 may be replaced by a foot pedal switch mounted to the base.

This invention has been described in detail with reference to a particular embodiment thereof, but it will be understood that various other modifications can be effected within the spirit and scope of this invention.

I claim:

1. A surgeon's chair for providing bodily support to a surgeon during a surgical process, said chair comprising:

a frame assembly;

an adjustable seat assembly attached to said frame assembly;

a dual pivoting support having a lower rotational section attached to said frame assembly, said lower rotational section having a free rotating end rotatable about a first vertical axis, and an upper rotational section attached to said free rotating end, said upper rotational section being rotatable with a vertically aligned support member about a second vertical axis laterally spaced from said first vertical axis;

a releasable locking device attached to said dual pivoting support between said upper and lower rotational sections, said releasable locking device being engageable at a location outside a periphery of said vertically aligned support member and remote from said second vertical axis enabling said upper rotational section to be adjustably locked in a desired radial position; and at least one pad attached to said upper rotational section to provide bodily support for the torso and arms of the surgeon.

2. An apparatus, as claimed in claim 1, further comprising:

a knee rest assembly attached to said frame assembly for reducing stress on the spine of the surgeon, said knee rest assembly being selectively adjustable to a desired distance from said seat assembly.

3. An apparatus, as claimed in claim 1 further comprising:

a wrist rest assembly attached to said upper rotational section, said wrist rest assembly being selectively adjustable to a desired distance from said upper rotational section.

4. An apparatus, as claimed in claim 1, further comprising:

a lifting mechanism positionable on said frame assembly for selectively positioning said seat assembly to a desired vertical height.

5. An apparatus, as claimed in claim 4, wherein said lifting mechanism further comprises:

a linear actuator connected to said frame assembly; and a means for raising and lowering said linear actuator such that said seat assembly is adjustably raised or lowered to a desired vertical height.

6. An apparatus, as claimed in claim 4, wherein said lifting mechanism further comprises:

a fluidic cylinder attached to said frame assembly; and a means for raising and lowering said fluidic cylinder such that said seat assembly is adjustably raised or lowered to a desired vertical height.

7. An apparatus, as claimed in claim 1, wherein said seat assembly comprises:

a first support means attached to said frame assembly; and a seat rotatably attached to said first support means rotatable in response to a rotational force applied by a seated surgeon.

8. An apparatus, as claimed in claim 1, wherein said releasable locking device comprises:

a swivel adjustment bracket connected to said vertically aligned support member positionable between said upper and lower rotational sections, said bracket having a generally horizontal arcuate slot with a plurality of spaced holes located along said slot; and at least one horizontal support arm having a first end attached to said upper rotational section and having a spring plunger assembly at a second end thereof, said spring plunger assembly being alignable with said spaced holes such that said upper rotational section can be selectively positioned and locked into a desired radial position by inserting said plunger assembly into one of said spaced holes.

9. An apparatus as claimed in claim 1, further comprising:

a locking mechanism attached to said upper rotational section for selectively positioning said upper rotational section to a desired vertical height.

10. An apparatus, as claimed in claim 1, wherein said releasable locking device comprises:

a locking element for selectively adjusting and locking said upper rotational section; and a receiving element for receiving said locking element, said receiving element having a plurality of arcuately spaced positions for receiving said locking element such that said upper rotational section is adjusted to any one of a plurality of desired radial positions.

11. A surgeon's chair for providing bodily support to a surgeon during a surgical process, said chair comprising:

a frame assembly;

an adjustable seat assembly attached to said frame assembly;

a lower rotational section having first and second ends, said first end of said lower rotational section rotatably mounted to said frame assembly about a first axis;

an upper rotational section having first and second ends, said first end of said upper rotational section rotatably mounted to said second end of said lower rotational section with a vertically aligned support member about a second axis, said upper and lower rotational sections being independently rotatable;

a releasable locking device attached to said upper rotational section, said releasable locking device being engageable at a location outside a periphery of said vertically aligned support member and remote from said second axis enabling said upper rotational section to be adjustably locked in a desired radial position; and at least one pad attached to said upper rotational section to provide bodily support for the torso and arms of the surgeon.

12. An apparatus, as claimed in claim 11, further comprising:

a knee rest assembly attached to said frame assembly, said knee rest assembly comprising an adjustable telescopic device having a plurality of pads which are selectively positionable at different desired distances from said seat assembly.

13. Apparatus, as claimed in claim 12, wherein said knee rest assembly comprises:

at least one mounting tube attached to said frame assembly;

at least one telescopic tube corresponding to said at least one mounting tube whereby said at least one telescopic tube is movably telescoped over said at least one mounting tube for adjustment to a desired length;

a locking device integral with said at least one telescoping tube for locking said at least one telescoping tube in a desired position; and a plurality of pads attached to said at least one telescopic tube.

14. An apparatus, as claimed in claim 11, further comprising:

a wrist rest assembly having at least one pad attached to said upper rotational section, said wrist rest assembly being selectively adjustable to retract or extend said at least one pad to a desired position from said upper rotational section.

15. An apparatus, as claimed in claim 11, further comprising:

a lifting mechanism positionable on said frame assembly for selectively positioning said seat assembly to a desired vertical height.

16. An apparatus, as claimed in claim 15, wherein said lifting mechanism further comprises:

a linear actuator connected to said frame assembly; and a means for raising and lowering said linear actuator such that said seat assembly is adjustably raised or lowered to a desired vertical height.

17. An apparatus, as claimed in claim 15, wherein said lifting mechanism further comprises:

a telescoping cylinder attached to said frame assembly; and a means for raising and lowering said telescoping cylinder such that said seat assembly is adjustably raised or lowered to a desired vertical height.

18. An apparatus, as claimed in claim 11 wherein said releasable locking device comprises:

a swivel adjustment bracket connected to said vertically aligned support member positionable between said upper and lower rotational sections, said bracket having a substantially horizontal arcuate slot with a plurality of spaced holes located along said slot; and at least one horizontal support arm attached to said upper rotational section, said at least one arm being aligned for receiving a spring plunger assembly, said spring plunger assembly alignable with said spaced holes such that said upper rotational section can be selectively positioned and locked into a desired radial position by inserting said plunger assembly into one of said spaced holes.

19. An apparatus, as claimed in claim 11, wherein said seat assembly comprises:

a first support means attached to said frame assembly; and a seat rigidly attached to said first support means.

20. An apparatus, as claimed in claim 11, further comprising a releasable locking mechanism attached to said upper rotational section for selectively positioning said upper rotational section to a desired vertical height.

* * * * *